US011426894B2

(12) United States Patent
Stoof et al.

(10) Patent No.: US 11,426,894 B2
(45) Date of Patent: Aug. 30, 2022

(54) HIGH LOAD LIFTER FOR AUTOMATED STAPLER

(71) Applicant: Kyocera Senco Industrial Tools, Inc., Cincinnati, OH (US)

(72) Inventors: Johan Johannes Stoof, Baambrugge (NL); Johannes Antonius Rudolf Grouve, Harderwijk (NL)

(73) Assignee: Kyocera Senco Industrial Tools, Inc., Cincinnati, OH (US)

( * ) Notice: Subject to any disclaimer, the term of this patent is extended or adjusted under 35 U.S.C. 154(b) by 552 days.

(21) Appl. No.: 16/570,249

(22) Filed: Sep. 13, 2019

(65) Prior Publication Data

US 2020/0086522 A1 Mar. 19, 2020

Related U.S. Application Data

(60) Provisional application No. 62/733,124, filed on Sep. 19, 2018.

(51) Int. Cl.
*B27F 7/38* (2006.01)

(52) U.S. Cl.
CPC ..... *B27F 7/38* (2013.01)

(58) Field of Classification Search
CPC ..... B27F 7/38
See application file for complete search history.

(56) References Cited

U.S. PATENT DOCUMENTS 3,278,103 A 10/1966 Juilfs
3,278,104 A 10/1966 Becht et al.
3,504,840 A 4/1970 Wandel
3,561,324 A 2/1971 Obergfell
3,674,041 A 7/1972 Beals
3,850,079 A 11/1974 Fehrs
3,895,562 A 7/1975 El Guindy
4,384,668 A 5/1983 Tutomu
4,436,237 A 3/1984 Vornberger et al.
5,474,222 A * 12/1995 Kanai ..... B25C 5/1624 227/120
5,702,047 A * 12/1997 Yoshie ..... B27F 7/36 227/120

(Continued)

OTHER PUBLICATIONS

International Search Report, PCT/US 19/50933, 20 pages (dated Sep. 13, 2019).

*Primary Examiner* — Praachi M Pathak
(74) *Attorney, Agent, or Firm* — Frederick H. Gribbell; Russell F. Gribbell

(57) ABSTRACT

An automated lift machine that feeds strips of staples into an automated stapling machine that can be used in a production line. The lift machine includes a lifter subassembly and a pusher subassembly, and a magazine for holding multiple strips of staples that are stacked on top of one another. A lift fork extends under of the legs of the second staple strip from the bottom, then lifts up all of the stacked staples in the magazine except for the bottom-most staple strip. After that occurs, the pusher forces the bottom-most staple strip from beneath the stacked staples in the magazine, then pushes that strip toward an exit position, into the feeder for the automated stapling machine. The pusher retracts and the lift fork gently lowers the stacked staples in the magazine until they bottom out, after which the lift fork retracts from the stack.

14 Claims, 9 Drawing Sheets

(56) References Cited

U.S. PATENT DOCUMENTS

| | | | | |
|---|---|---|---|---|
| 5,791,548 | A * | 8/1998 | Udagawa | B25C 5/1606 227/120 |
| 5,873,510 | A | 2/1999 | Hirai | |
| 7,784,560 | B2 | 8/2010 | Mina et al. | |
| 2002/0017549 | A1 * | 2/2002 | Yamaguchi | B27F 7/38 227/155 |
| 2012/0223120 | A1 | 9/2012 | Mina | |
| 2016/0151900 | A1 | 6/2016 | Wu et al. | |
| 2016/0319812 | A1 | 11/2016 | Krech et al. | |

* cited by examiner

HIGH LOAD LIFTER FOR AUTOMATED STAPLER

CROSS-REFERENCE TO RELATED APPLICATIONS

The present application claims priority to provisional patent application Ser. No. 62/733,124, titled "HIGH LOAD LIFTER FOR AUTOMATED STAPLER," filed on Sep. 9, 2018.

TECHNICAL FIELD

An automated lift machine (or "lifter") is disclosed for use in a magazine that feeds strips of staples into an automated stapling machine that can be used in a production line. The lift machine includes a lifter subassembly and a pusher subassembly, as well as a magazine for holding multiple strips of staples that are stacked on top of one another. The lifter subassembly includes a lift fork that can extend under of the legs of the second staple strip from the bottom, and then lift up all of the stacked staples in the magazine except for the lowermost (or bottom-most) staple strip. After that occurs, the pusher subassembly forces the lowermost staple strip from beneath the stacked staples in the magazine, and pushes that particular staple strip toward an exit position and into the feeder for the automated stapling machine. Once that has been accomplished, the pusher retracts and the lift fork gently lowers the stacked staples in the magazine until they bottom out, after which the lift fork retracts from the stack. The lift fork then indexes up so that it is ready to extend into the second from the bottom staple strip, to begin a new cycle of feeding staple strips into the automated stapler.

STATEMENT REGARDING FEDERALLY SPONSORED RESEARCH OR DEVELOPMENT

None.

BACKGROUND

Industrial stapling tools are used intensely in some automated production environments. Such industrial staplers can be part of a production line, and such high speed production lines are subject to much vibration because of the high speed in which the stapling tool operates. In general, industrial stapling tools shoot at high speed and have a large magazine to hold a significant number of stacked staple strips. With large staples in particular, the stacked staple strips are quite heavy as they are stacked in the magazine that feeds an industrial stapling tool.

Due to the high weight of the stacked staple strips, in combination with the vibrations and the conventional method of transport of the staple strips that are fed to the industrial stapling tools, there is an increased risk of breaking staples as they are being introduced into the stapling tool. Such broken staples can possibly result in feeding errors which will result in down time for the production line. In most systems, the individual staples are glued together to create the staple strips and, as noted below, these can be rather large staples with rather long legs. A wide variety of vibrations are caused by movement of the stapling tool and the actual stapling process, and also by movement of the staples within the magazine. Furthermore, the lowest staple strip in the magazine is pushed away from under the stacked staples, and in conventional systems the remaining stacked staple strips fall down in the magazine as soon as the lowest staple strip has been moved into the feeder of the stapling tool. This sudden falling of the stacked staple strips increases the possibility of breaking portions of the staples. And if one or more staple strips will break while in the magazine, this can cause an error in the feeding mechanism and lead to a disruption of the production process.

SUMMARY

It is an advantage of the technology disclosed herein to provide an integrated lift mechanism that insures that stacked staple strips in a feeder magazine are lifted before the lowest staple strip is pushed from beneath the remaining staple strips, and then the stacked staple strips will be lowered in a controlled manner to prevent any sudden shocks or other forces that may tend to break any of the staples in the remaining staple strips.

Additional advantages and other novel features will be set forth in part in the description that follows and in part will become apparent to those skilled in the art upon examination of the following or may be learned with the practice of the technology disclosed herein.

To achieve the foregoing and other advantages, and in accordance with one aspect, a lifting machine for feeding staples is provided, which comprises: (a) a magazine, including a space to hold a plurality of staple strips that are stacked, one staple strip atop a next staple strip, wherein there is a first staple strip disposed at a bottom-most position in the magazine, and a second staple strip disposed at a position just above the first staple strip; (b) a pusher subassembly comprising: (i) a first linear cylinder; including a first movable rod; (ii) a pusher that has at least one degree of freedom of movement in a horizontal direction and that is sized and shaped to contact an end portion of the first staple strip; and (iii) a cylinder connector that is in mechanical communication with the pusher and which moves in accordance to a position of the first movable rod of the first linear cylinder; (c) a lifter subassembly, comprising: (i) a lift fork that has at least two degrees of freedom of movement, including a first degree of freedom to move horizontally and a second degree of freedom to move vertically; wherein, during operation: (d)(i) the lift fork is configured to move horizontally to a retracted position; (ii) the lift fork is configured to move vertically to an upper position that corresponds to a vertical elevation of the second staple strip; (iii) the lift fork is configured to move horizontally to an extended position that is at least partially within an open area of the second staple strip, but is not yet making physical contact with the second staple strip; (iv) while remaining in the horizontally extended position, the lift fork is configured to move vertically upward until it makes physical contact with at least one leg of second staple strip, then to continue to move slightly upward while lifting the plurality of staple strips, except for the first staple strip, which is not lifted upward, until a gap is created between a bottom-most surface of the second staple strip and a top-most surface of the first staple strip; (e)(i) the pusher is configured to move horizontally from its retracted position toward its extended position, until it makes physical contact with the first staple strip; (ii) the pusher is configured to continue moving toward the extended position, while pushing the first staple strip toward an exit position, until the first staple strip has cleared from beneath the second staple strip; (iii) the pusher is configured to move horizontally from its extended position toward its retracted position, until it clears from beneath the second staple strip, while releasing from contact from the first staple strip; (f)(i) the lift fork is configured to move vertically downward to a lower position until the second staple strip rests up on a surface, the downward movement being controlled so as to be sufficiently gentle so as to not break any of the individual staples that comprise the second staple strip; (ii) the lift fork is configured to move horizontally from its extended position to its retracted position, while not making physical contact with the second staple strip; (iii) the lift fork is configured to move vertically upward from the lower position to the upper position; and (g) the second staple strip has now become disposed at the bottom-most position in the magazine, and the first staple strip has been moved to the exit position.

In accordance with another aspect, a method for using a lifting machine that feeds staples is provided, in which the method comprises the following steps: (a) providing a magazine, including a space to hold a plurality of staple strips that are stacked, one staple strip atop a next staple strip, wherein there is a first staple strip disposed at a bottom-most position in the magazine, and a second staple strip disposed at a position just above the first staple strip; (b) providing a pusher subassembly that comprises: (i) a first linear cylinder; including a first movable rod; (ii) a pusher that has at least one degree of freedom of movement in a horizontal direction and that is sized and shaped to contact an end portion of the first staple strip; and (iii) a cylinder connector that is in mechanical communication with the pusher and which moves in accordance to a position of the first movable rod of the first linear cylinder; (c) providing a lifter subassembly that comprises: (i) a lift fork that has at least two degrees of freedom of movement, including a first degree of freedom to move horizontally and a second degree of freedom to move vertically; wherein, during operation: (d)(i) moving the lift fork horizontally to a retracted position; (ii) moving the lift fork vertically to an upper position that corresponds to a vertical elevation of the second staple strip; (iii) moving the lift fork horizontally to an extended position that is at least partially within an open area of the second staple strip, but is not yet making physical contact with the second staple strip; (iv) while remaining in the horizontally extended position, moving the lift fork vertically upward until it makes physical contact with at least one leg of second staple strip, then continuing to move slightly upward while lifting the plurality of staple strips, except for the first staple strip, which is not lifted upward, until a gap is created between a bottom-most surface of the second staple strip and a top-most surface of the first staple strip; (e)(i) moving the pusher horizontally from its retracted position toward its extended position, until it makes physical contact with the first staple strip; (ii) moving the pusher further toward the extended position, while pushing the first staple strip toward an exit position, until the first staple strip has cleared from beneath the second staple strip; (iii) moving the pusher horizontally from its extended position toward its retracted position, until it clears from beneath the second staple strip, while releasing from contact from the first staple strip; (f)(i) moving the lift fork vertically downward to a lower position until the second staple strip rests up on a surface, the downward movement being controlled so as to be sufficiently gentle so as to not break any of the individual staples that comprise the second staple strip; (ii) moving the lift fork horizontally from its extended position to its retracted position, while not making physical contact with the second staple strip; (iii) moving the lift fork vertically upward from the lower position to the upper position; and (g) the second staple strip has now become disposed at the bottom-most position in the magazine, and the first staple strip has been moved to the exit position.

Still other advantages will become apparent to those skilled in this art from the following description and drawings wherein there is described and shown a preferred embodiment in one of the best modes contemplated for carrying out the technology. As will be realized, the technology disclosed herein is capable of other different embodiments, and its several details are capable of modification in various, obvious aspects all without departing from its principles. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the technology disclosed herein, and together with the description and claims serve to explain the principles of the technology. In the drawings:

DETAILED DESCRIPTION

Figure 1:
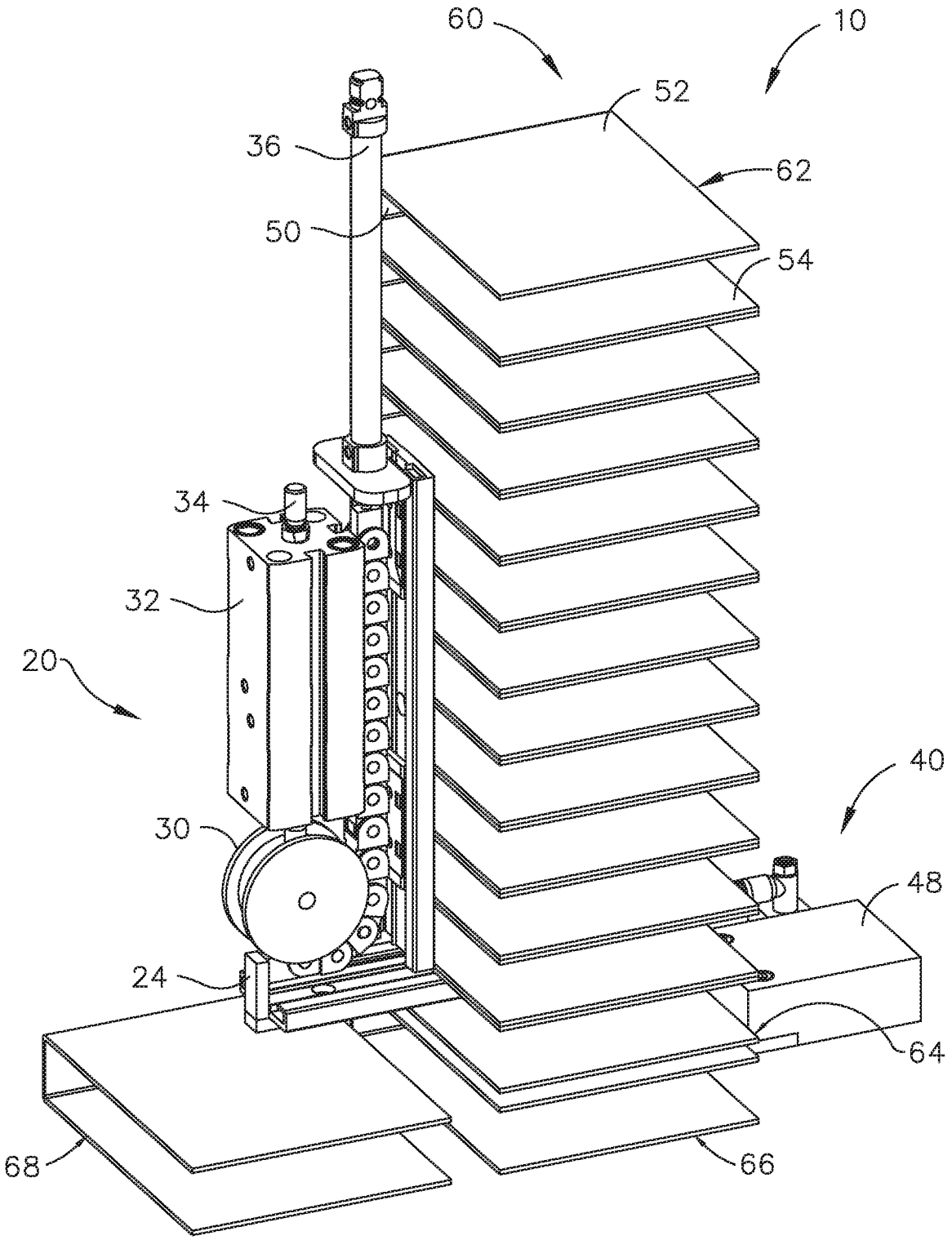
FIG. 1 is a perspective view from the front and above of an industrial lift machine for use with an automated stapling tool, as constructed in accordance with the principles of the technology disclosed herein.

Reference will now be made in detail to the present preferred embodiment, an example of which is illustrated in the accompanying drawings, wherein like numerals indicate the same elements throughout the views.

It is to be understood that the technology disclosed herein is not limited in its application to the details of construction and the arrangement of components set forth in the following description or illustrated in the drawings. The technology disclosed herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The terms "first" and "second" preceding an element name, e.g., first inlet, second inlet, etc., are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

Referring now to FIG. 1, a lift machine for large staples is generally designated by the reference numeral 10, and is depicted in a mode where there are several stacks of staples ready for use in an automated industrial stapling machine. The industrial lift mechanism 10 includes a lifter subassembly generally designated by the reference numeral 20, a pusher subassembly generally designated by the reference numeral 40, and a magazine subassembly generally designated by the reference numeral 60.

As can be seen in FIG. 1, the individual staples of each strip are quite long, as compared to their width. A top (or uppermost) staple strip is generally designated by the reference numeral 62; in FIG. 1, the top leg of those staples is designated at reference numeral 52, the bottom leg at reference numeral 54, and the connecting transverse leg is at reference numeral 50. In FIG. 1, the magazine 60 is holding a large number of individual staple strips, in which the top staple strip is designated at 62 (as noted above), the bottom-most staple strip is designated at 66, a second from bottom staple strip is designated at 64, and a staple strip that is being fed to the actual stapling machine is designated at the reference numeral 68.

FIG. 1 also shows a few of the other important components in some detail. For example, the lifter subassembly 20 includes several individual components, such as a connecting member 24 to a lift fork 22 (see other views), an "energy chain" 26 which acts as a hose and cable carrier (seen in other views), a guide wheel 30 that more or less acts to keep the energy chain in position as it moves, a cylinder short 32, a cylinder connector 34, and an energy chain linear position control cylinder 36. FIG. 1 also illustrates a mechanical member referred to as a "pusher," at reference numeral 48.

Figure 2:
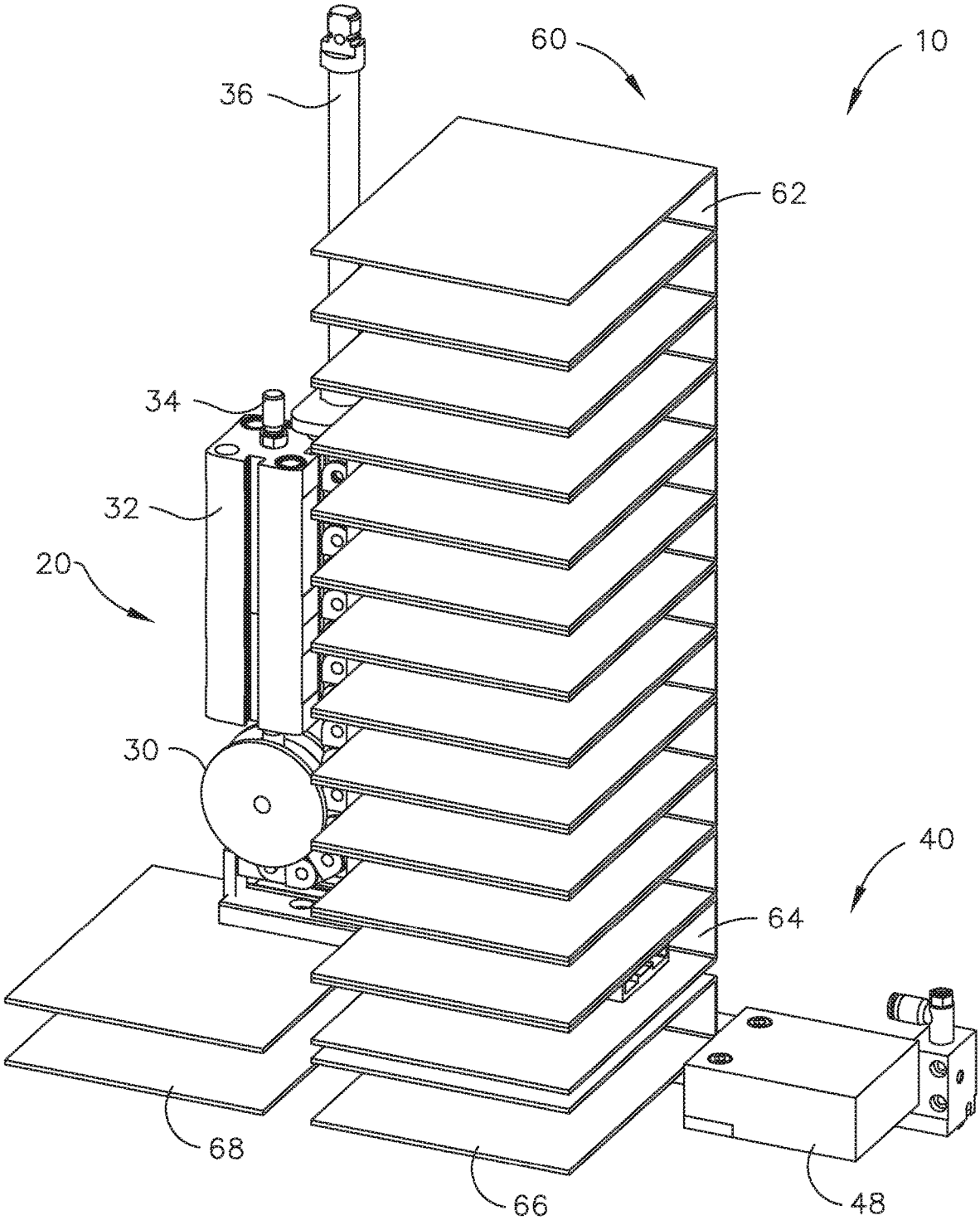
FIG. 2 is a perspective view of the lift machine of FIG. 1, taken from a different side but also from the front and above.

Referring now to FIG. 2, many of these same components are illustrated as were seen in FIG. 1. FIG. 2 more clearly illustrates the orientation of the energy chain 26 as it fits inside the outer discs of the guide wheel 30. FIG. 2 also shows a little more detail of the pusher subassembly 40, which are better illustrated in the later views.

In the two views of FIGS. 1 and 2, it can be seen that the "bottom" staple strip 66 is at the same elevation as the staple strip 68 that has been fed toward the actual stapling machine. All the other staple strips are still loaded in the magazine 60, and they are stacked one above the other, starting with the second staple strip from the bottom at reference numeral 64, and the "top" or uppermost staple strip 62.

Figure 3:
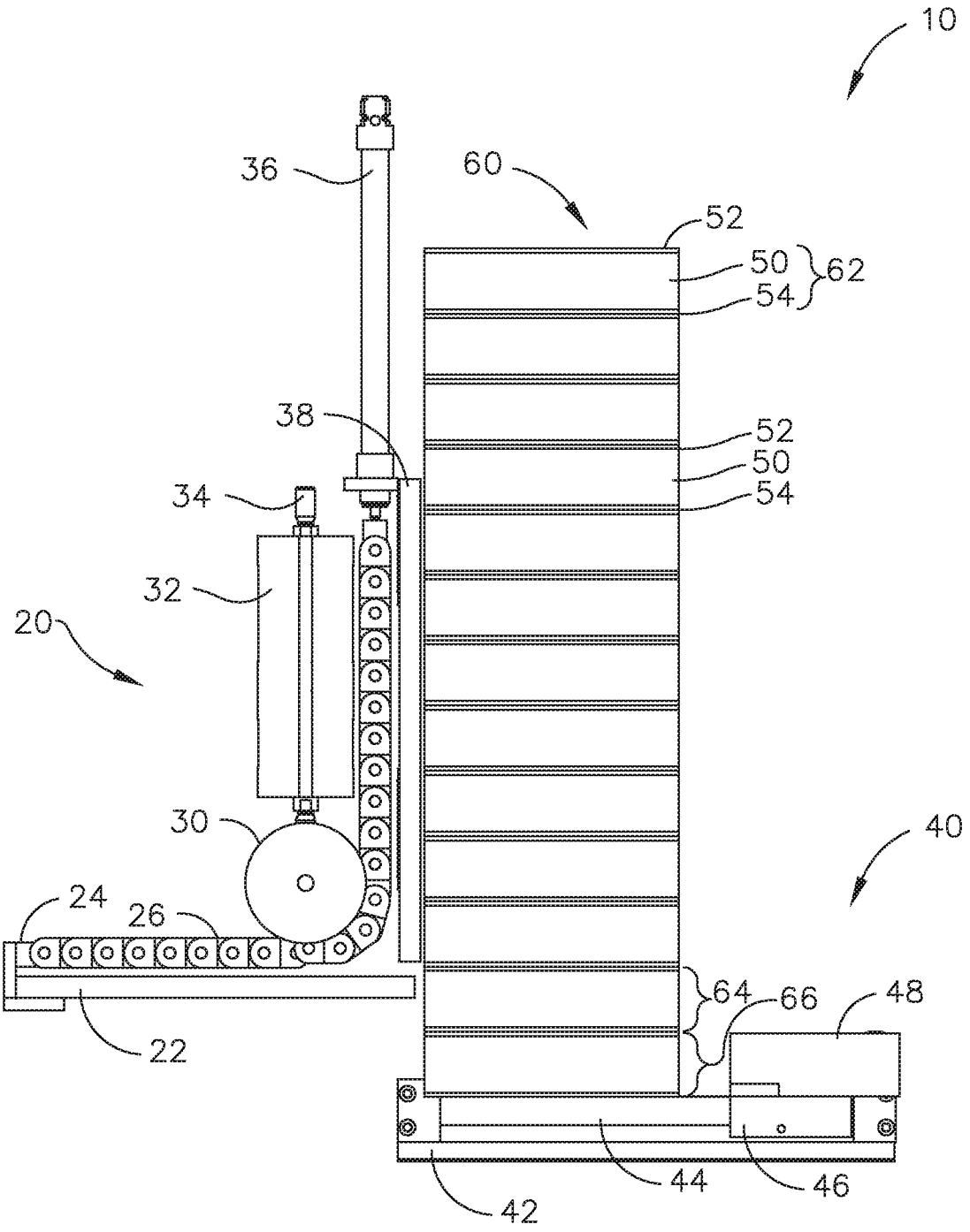
FIG. 3 is a front elevational view of an initial position of the lift machine of FIG. 1, which can be referred to as "step 0."

Referring now to FIG. 3, the lift mechanism 10 is depicted in its initial position, before any staples have been fed to an associated industrial stapling machine (typically found in a production line setting). This view of FIG. 3 is essentially "step 0" of the procedure for using this machine. The lifter subassembly 20 includes a lift fork 22, a mechanical bracket that connects to the lift fork at 24, the energy chain (hose and cable carrier) 26, the rotatable guide wheel 30, the cylinder short 32, the connection to the cylinder short at 34, the energy chain cylinder 36, and a vertical guidance member 38 which acts as a vertical support to keep the stacked staples in their proper positions within the magazine 60.

The pusher subassembly 40 includes a linear cylinder 44, a support at 42 for the linear cylinder (which could also be referred to as a "base"), a cylinder connection 46, and a mechanical pusher member 48. The pusher 48 is sized and shaped to make physical contact with the "end staple" of the staple strip 66, and then to literally push that staple strip to the left (in this view) at the proper time in the operating cycle.

The magazine 60 includes several stacks of staples which are organized in staple strips. The uppermost or "top" staple strip is at 62, while the bottom most or "bottom" staple strip is at 66. The staple strip that is just above the bottom staple strip (also referred to as the "second from bottom" staple strip) is at 64; as can be seen, all these staple strips are stacked immediately one upon the top of the next below. Each staple strip has a top leg 52, a bottom leg 54, and a shorter transverse leg at 50. The relative dimensions of the individual staples in the staple strips is better seen in the perspective views of FIGS. 1 and 2.

As can be seen in FIG. 3, the pusher 48 is all the way to the right (in this view), which is its retracted position; the lift fork 22 is all the way to the left (in this view), which is its retracted position. As such, neither of those mechanical parts is interacting with any of the staple strips in this initial condition "step 0." Note that the lift fork 22 presently is vertically positioned at the same elevation as the second staple strip 64. (In later views, the lift fork is illustrated at different vertical positions.) In this orientation, the pusher 48 is at a distal position with respect to an "exit" position, where the staple strips will ultimately be fed into an automated stapling machine.

Figure 4:
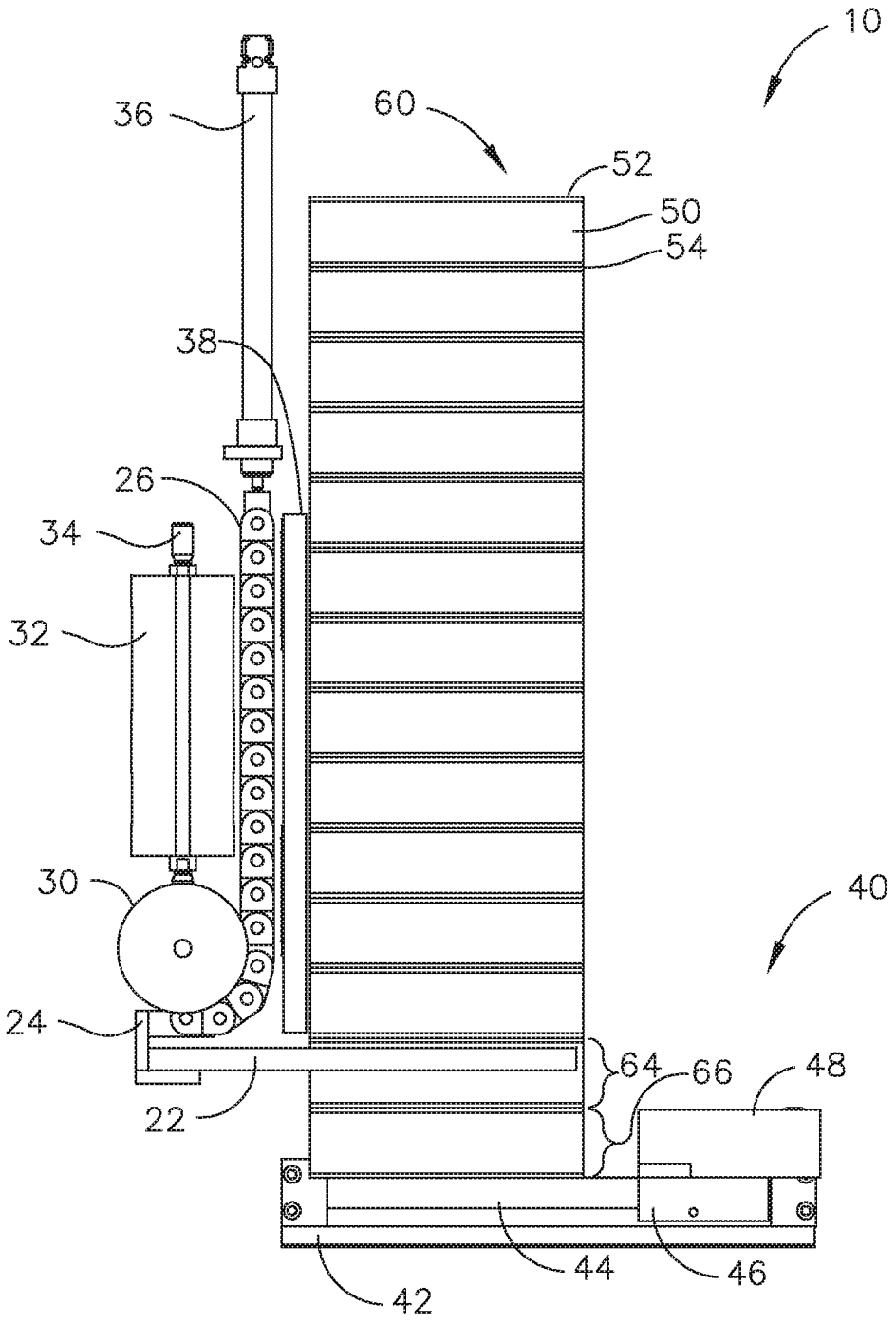
FIG. 4 is a side elevational view of the lift machine of FIG. 1 showing a first step for feeding a magazine of staple strips into an industrial stapler tool.

Referring now to FIG. 4, this view illustrates the first step in the procedure for feeding a staple strip to a production stapling tool. In this first step, the lift fork 22 has moved to the right (in this view) into its extended position, where it is now positioned beneath the top leg of the second staple strip 64. The pusher 48 of the pusher subassembly has remained at its initial position in this step 1 depicted in FIG. 4. Again, the lift fork 22 is still vertically positioned at the same elevation as the second staple strip 64. Note that the lift fork's extended position is at least partially within an open area of the second staple strip 64, but is not yet making physical contact with that second staple strip.

Figure 5:
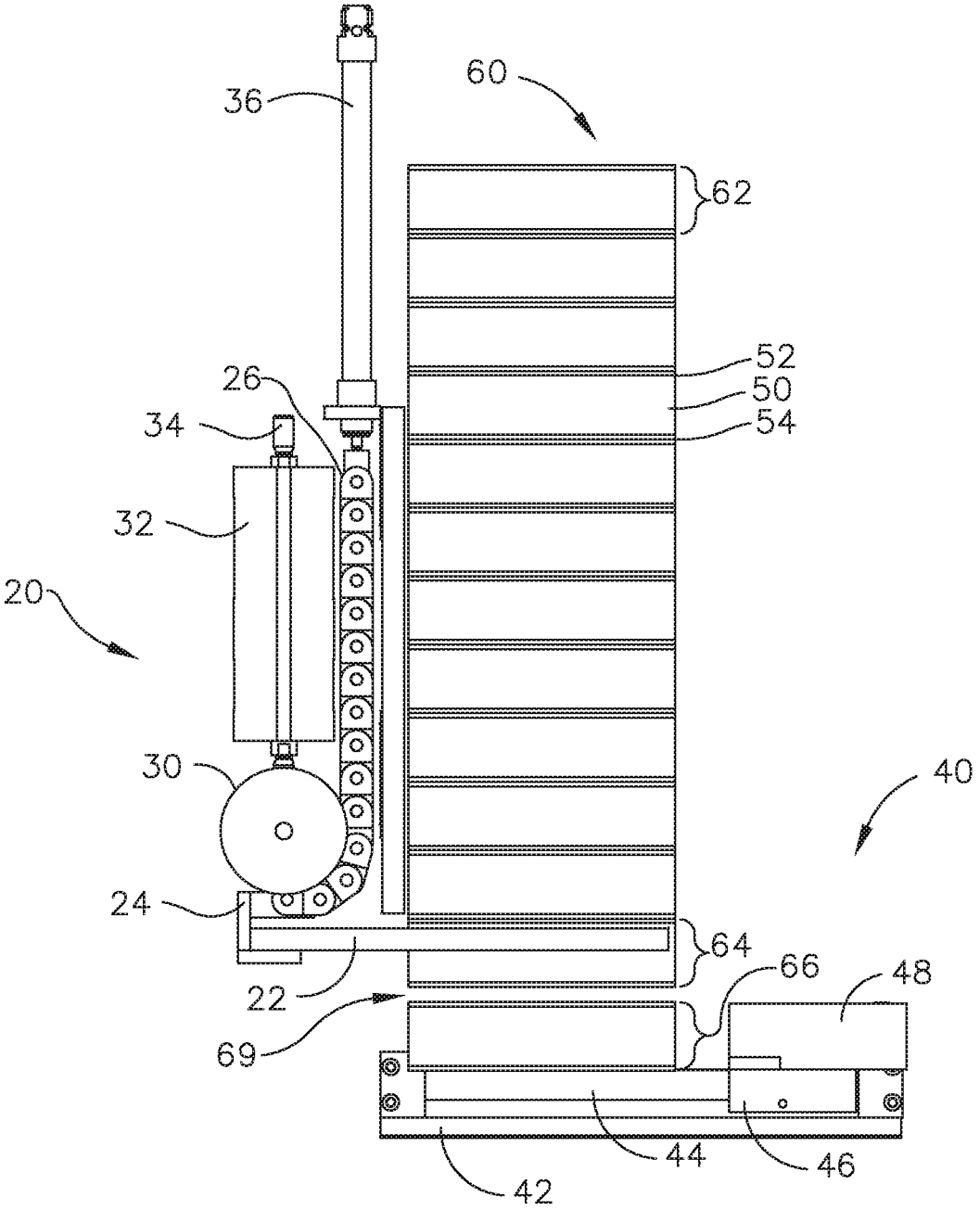
FIG. 5 is a side elevational view of the lift machine of FIG. 1 showing a second step for feeding a magazine of staple strips into an industrial stapler tool.

Referring now to FIG. 5, the second step in this procedure of this staple strip feeding machine is depicted, in which the lift fork 22 has now been raised up a small distance, and is now making physical contact with that second staple strip 64. In this new position of "step 2," there is a clear "gap" at 69 that is visible between the bottom staple strip 66 and the "second from the bottom" staple strip 64. In one embodiment of such a machine, the lift fork 22 lifts the remaining staple strips a sufficient height to create a gap of about 5 millimeters.

In FIG. 5, the pusher 48 of the pusher subassembly 40 is still in its initial position. It should be noted that the lift fork 22 has been vertically repositioned so that it is somewhat above its previous elevation; now it is somewhat higher in elevation than the second staple strip's original elevation, which is the reason the "gap" has been created between the second staple strip 64 and the bottom-most staple strip 66.

Figure 6:
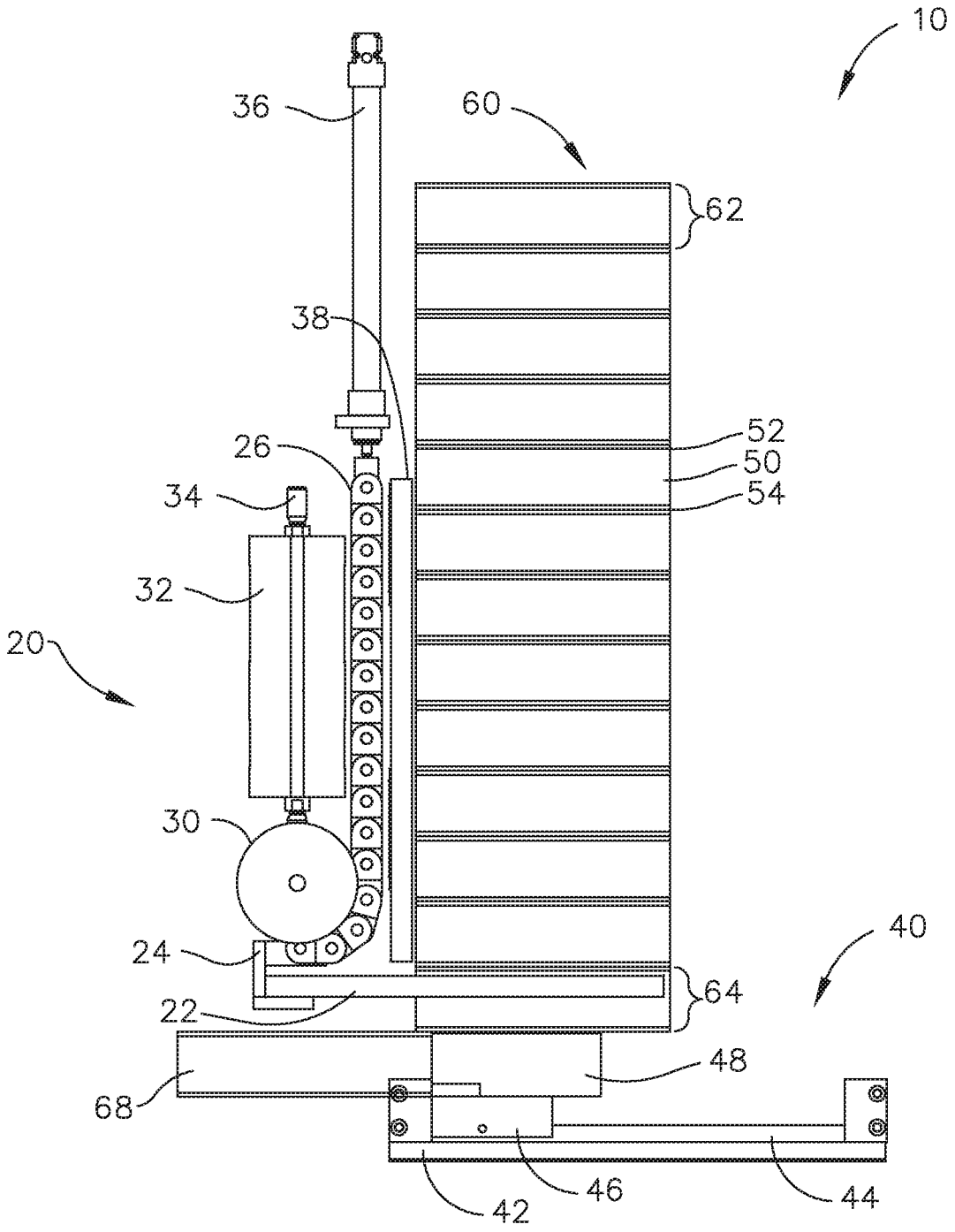
FIG. 6 is a side elevational view of the lift machine of FIG. 1 showing a third step for feeding a magazine of staple strips into an industrial stapler tool.

Referring now to FIG. 6, a third step in the procedure for this industrial lift machine is depicted, in which the lowest staple strip has been pushed away by the pusher 48. As can be seen by viewing FIG. 6, the lift fork 22 is still holding all the staple strips except for the bottom-most staple strip. The original bottom-most staple strip 66 has been horizontally pushed by the mechanical pusher 48 towards the left (in this view) as the pusher moved toward its extending position, and that lowermost staple strip is now referred to by the reference numeral 68 as representing a staple strip that has been fed toward the actual industrial stapler. The left-most surface of the pusher 48 came into physical contact with the bottom-most staple strip 66, and then continued to extend to the left (in this view), thereby "pushing" that bottom-most staple strip toward the left (in this view), toward an "exit position."

In this view of FIG. 6, there no longer is a "bottom-most" staple strip that would be referred to by the reference numeral 66. Instead, the second from the bottom staple strip 64 is now positioned as the lowermost strip among all the stacked staple strips in the magazine 60.

The pusher 48 is attached to the cylinder connection 46 that is part of the linear cylinder 44. The base or support member 42 does not change its position, and instead, only the linear cylinder and its attachments at 46 and 48 are moved. The staple strip 68 is moved away from the magazine 60, including all of the remaining staple strips that are still stacked in the magazine. As can be seen in FIG. 6, the "fed" staple strip 68 is still in the process of moving toward the left (in this view), and has not yet completely cleared from beneath the rest of the stacked staple strips. However, the pusher 48 will continue to move toward its extended position until that fed staple strip 68 has completely cleared from beneath the rest of the stacked staple strips—see FIG. 7, for example.

Figure 7:
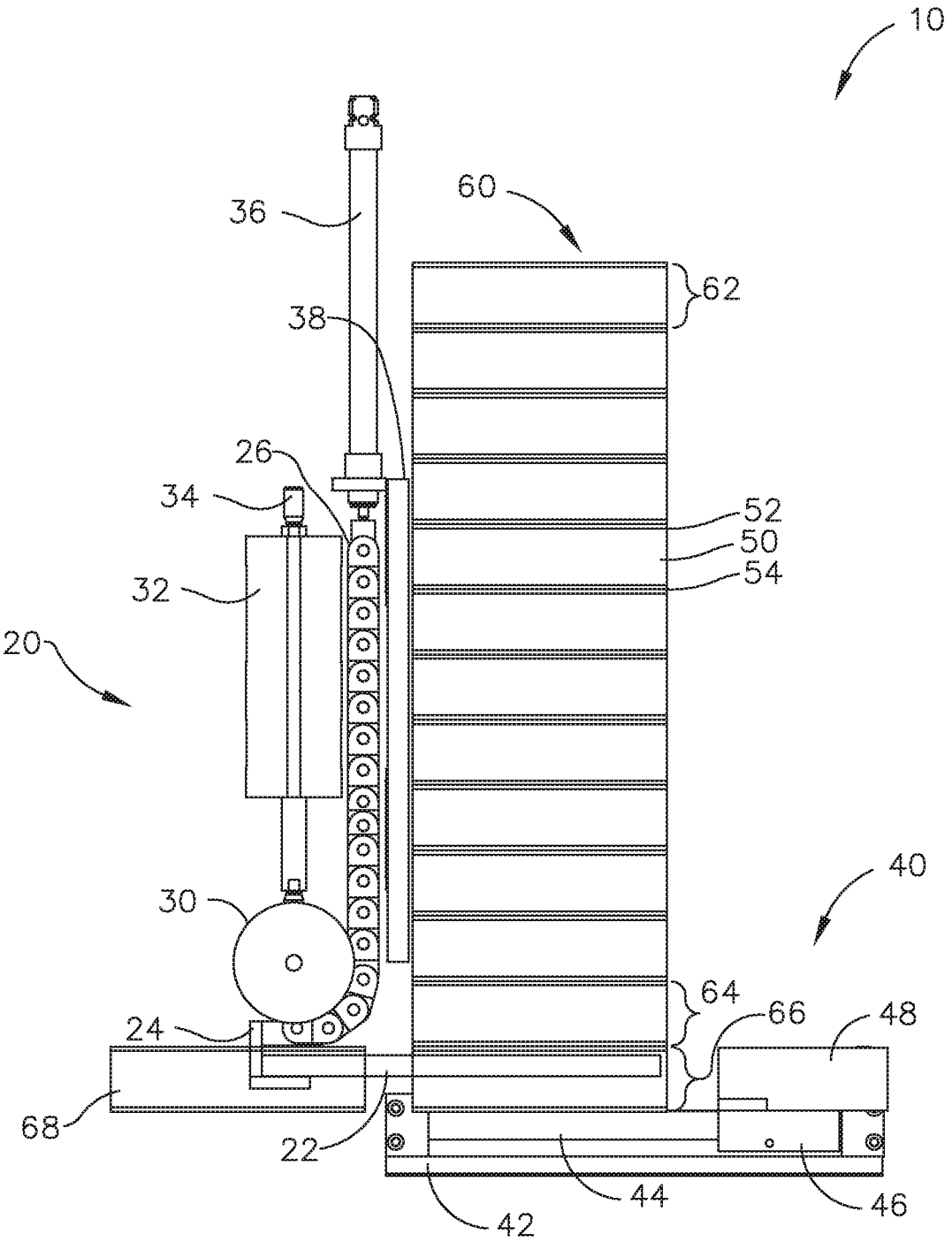
FIG. 7 is a side elevational view of the lift machine of FIG. 1 showing a fourth step for feeding a magazine of staple strips into an industrial stapler tool.

Referring now to FIG. 7, a fourth step in the procedure for operating this industrial lift machine is depicted, in which the "fed" staple strip 68 has been pushed farther toward the left, and the pusher 48 has been retracted back toward the right (in this view). The pusher 48 has moved from its extended position toward its retracted position, until it has cleared from beneath what previously was the second staple strip. While making this movement, the pusher 48 released from its contact with the fed staple strip 68. In this orientation, the pusher 48 is at a proximal position with respect to the "exit" position, where the staple strips are fed into an automated stapling machine, as per the staple strip 68.

Additionally in FIG. 7, the lift fork 22 has been elevationally lowered to the point where the former second staple strip has now become the bottom-most staple strip 66, and is now positioned on top of the linear cylinder 44. As can be seen in FIG. 7, the bottom-most staple strip 66 and the "fed" staple strip 68 are both at the same elevation. Since there is a "new" bottom-most staple strip 66, there is also a "new" second from the bottom staple strip 64. The stack of staple strips is still positioned in the magazine 60, and there is an uppermost staple strip 62. It will be understood that additional staple strips are continually being introduced into the magazine 60 as overall automated stapling machine operates, so that the bottom-most staple strips are moved to feed into the actual automatic stapling machine, as per the "fed" staple strip 68.

As noted above, when the lift fork 22 moves (vertically) downward so as to set the entire stack of staple strips in the magazine 60 down toward the linear cylinder 44, this is a controlled downward movement that is precisely controlled so as to be sufficiently gentle to prevent any significant damage to the individual staples of the bottom-most staple strip 66. In other words, this controlled move is designed so as to not break any of the individual staples that comprise the bottom-most staple strip 66. This step 4 of the procedure illustrates one of the chief advantages of this improved technology disclosed herein.

Figure 8:
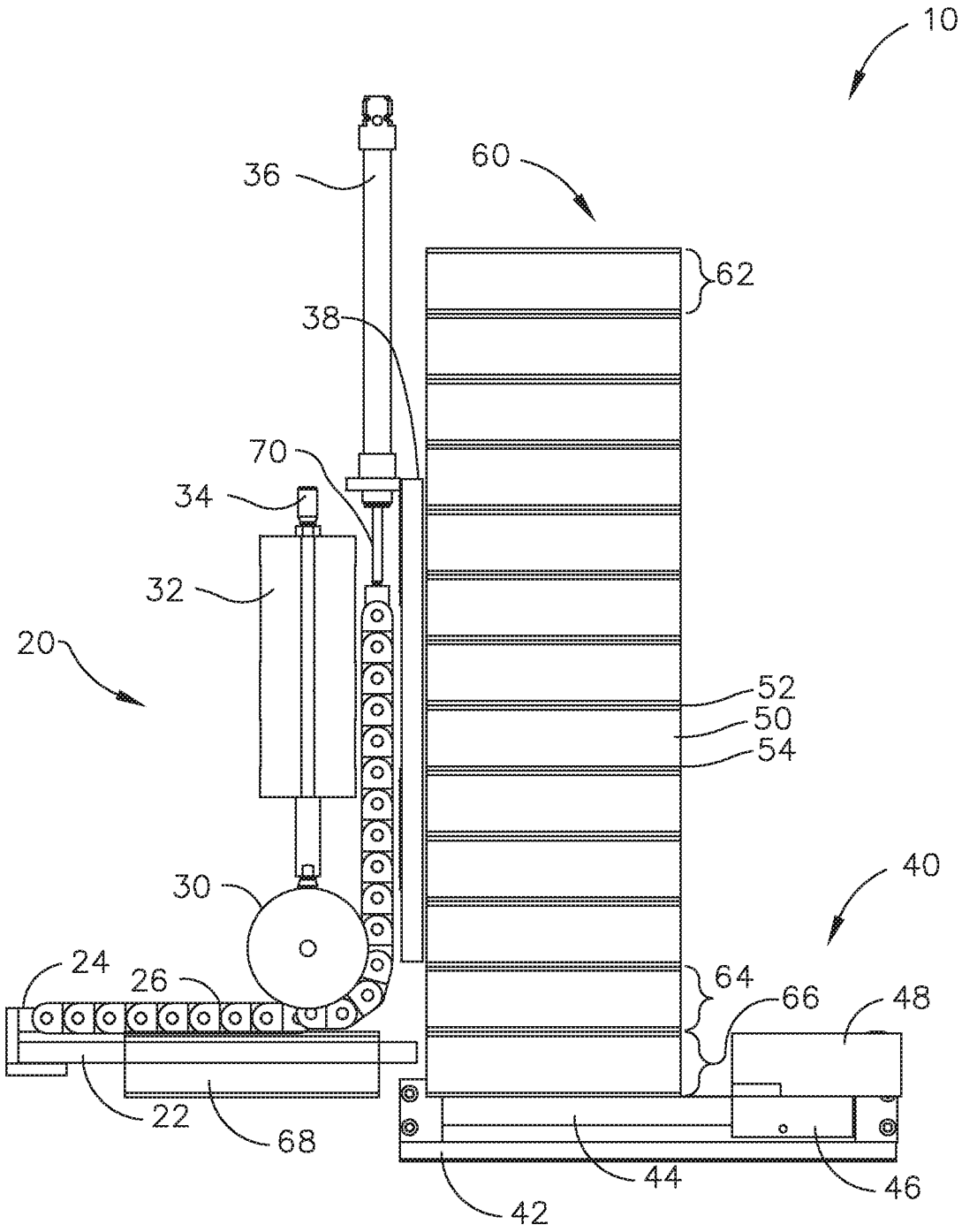
FIG. 8 is a side elevational view of the lift machine of FIG. 1 showing a fifth step for feeding a magazine of staple strips into an industrial stapler tool.

Referring now to FIG. 8, a fifth step in the procedure for using the industrial lift mechanism is illustrated, in which the lift fork 22 releases from the stacked staple strips. As can be seen, the lift fork has moved to the left (in this view) and the energy chain 26 has been extended toward the left to maintain contact with the lift fork connection member 24. The energy chain cylinder 36 has been extended, and that extension is visible at 70 on FIG. 8. The pusher 48 is still in its retracted position all the way to the right (in this view).

Figure 9:
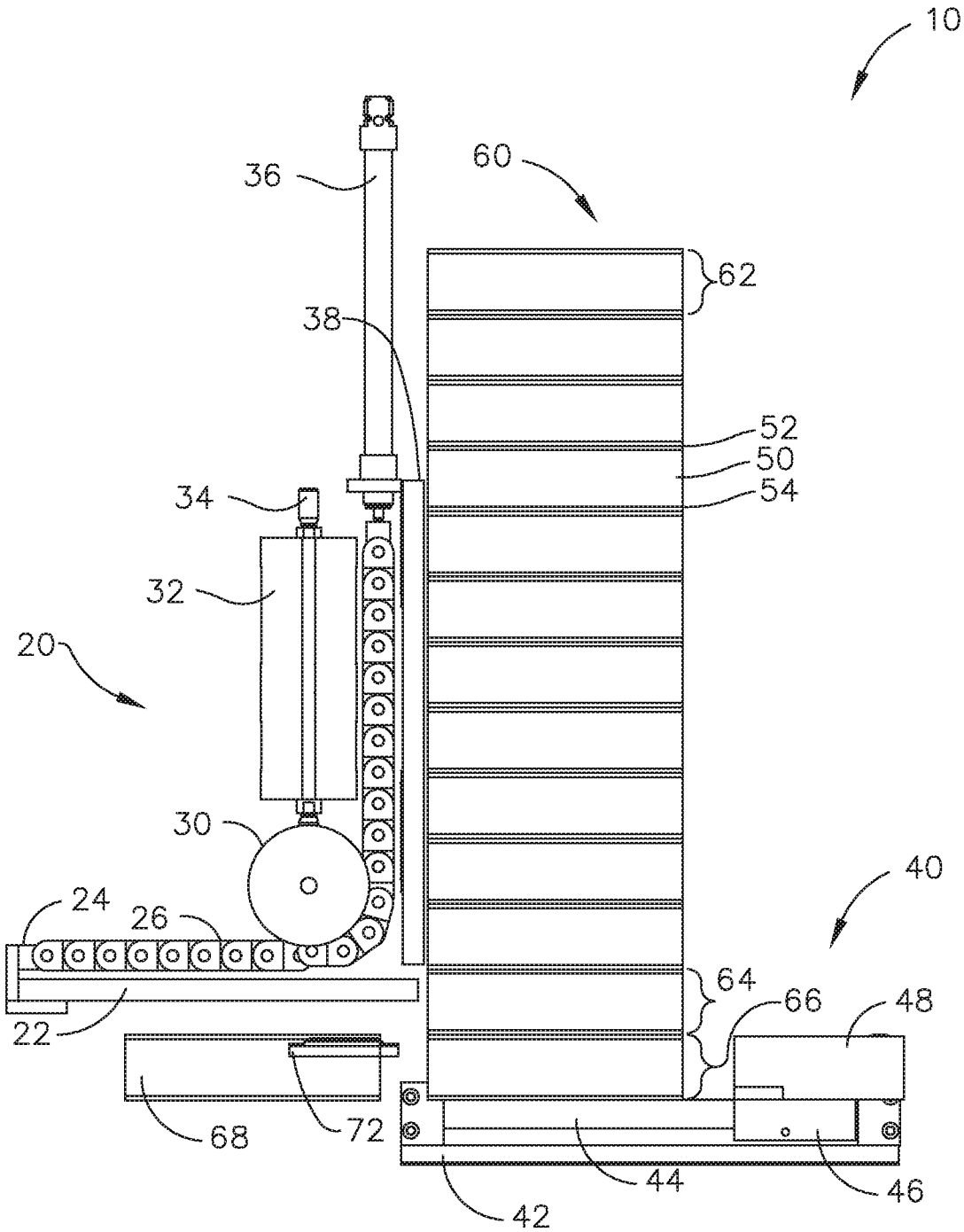
FIG. 9 is a side elevational view of the lift machine of FIG. 1 showing a sixth step for feeding a magazine of staple strips into an industrial stapler tool.

Referring now to FIG. 9, the lift fork is now vertically raised into its initial position in this sixth step of the use of the industrial lift machine. This is the end of one complete cycle of these steps for feeding stacked staples into an automated stapling machine. The main difference between this view of FIG. 9 and the "step 0" of FIG. 3, is that in FIG. 9 there is a "fed" staple strip at 68, which is now being fed into the industrial automated stapling machine. In addition, a horizontal guidance member (or support) is viewed at 72 that helps to guide this fed staple strip 68.

It will be understood that the lifter subassembly 20 includes at least two actuators for controlling the vertical movements of the lift fork 22, and for controlling the horizontal movements of the lift fork 22. The cylinder short 32 with its connection cylinder 34, and the energy chain cylinder 36 can act as those two actuators.

It will also be understood that the staples themselves can have more than one physical orientation and still be used with the lifting machine 10 of the present technology. Each staple has a transverse leg and two penetrating legs (which penetrate into a "target" substrate). For example, as the staple strips are loaded into the magazine, the individual staples can be oriented so that their transverse leg is vertical and their two penetrating legs are horizontal. In that orientation, when the lift fork moves vertically upward until it makes physical contact with a leg 52 of the staple strip, the lift fork contacts one of the horizontal penetrating legs. This is the orientation that is depicted in the drawings of FIGS. 1-9.

On the other hand, as the staple strips are loaded into the magazine, the individual staples can be oriented so that their transverse leg is horizontal and their two penetrating legs are vertical. In this second orientation, when the lift fork moves vertically upward until it makes physical contact with a leg of the staple strip, the lift fork contacts the transverse leg. This orientation is not illustrated in the drawings of FIGS. 1-9, but is easily understood by a trained engineer.

As used herein, the term "proximal" can have a meaning of closely positioning one physical object with a second physical object, such that the two objects are perhaps adjacent to one another, although it is not necessarily required that there be no third object positioned therebetween. In the technology disclosed herein, there may be instances in which a "male locating structure" is to be positioned "proximal" to a "female locating structure." In general, this could mean that the two male and female structures are to be physically abutting one another, or this could mean that they are "mated" to one another by way of a particular size and shape that essentially keeps one structure oriented in a predetermined direction and at an X-Y (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal." Or, two or more possible locations for a particular point can be specified in relation to a precise attribute of a physical object, such as being "near" or "at" the end of a stick; all of those possible near/at locations could be deemed "proximal" to the end of that stick. Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

It will be understood that the various components that are described and/or illustrated herein can be fabricated in various ways, including in multiple parts or as a unitary part for each of these components, without departing from the principles of the technology disclosed herein. For example, a component that is included as a recited element of a claim hereinbelow may be fabricated as a unitary part; or that component may be fabricated as a combined structure of several individual parts that are assembled together. But that "multi-part component" will still fall within the scope of the claimed, recited element for infringement purposes of claim interpretation, even if it appears that the claimed, recited element is described and illustrated herein only as a unitary structure.

All documents cited in the Background and in the Detailed Description are, in relevant part, incorporated herein by reference; the citation of any document is not to be construed as an admission that it is prior art with respect to the technology disclosed herein.

The foregoing description of a preferred embodiment has been presented for purposes of illustration and description. It is not intended to be exhaustive or to limit the technology disclosed herein to the precise form disclosed, and the technology disclosed herein may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the technology disclosed herein. The embodiment(s) was chosen and described in order to illustrate the principles of the technology disclosed herein and its practical application to thereby enable one of ordinary skill in the art to utilize the technology disclosed herein in various embodiments and with various modifications as are suited to particular uses contemplated. This application is therefore intended to cover any variations, uses, or adaptations of the technology disclosed herein using its general principles. Further, this application is intended to cover such departures from the present disclosure as come within known or customary practice in the art to which this technology disclosed herein pertains and which fall within the limits of the appended claims.

What is claimed is:

1. A lifting machine for feeding staples, comprising:

(a) a magazine, including a space to hold a plurality of staple strips that are stacked, one staple strip atop a next staple strip, wherein there is a first staple strip disposed at a bottom-most position in said magazine, and a second staple strip disposed at a position just above said first staple strip;

(b) a pusher subassembly comprising:

(i) a first linear cylinder; including a first movable rod;

(ii) a pusher that has at least one degree of freedom of movement in a horizontal direction and that is sized and shaped to contact an end portion of said first staple strip; and (iii) a cylinder connector that is in mechanical communication with said pusher and which moves in accordance to a position of said first movable rod of the first linear cylinder;

(c) a lifter subassembly, comprising:

(i) a lift fork that has at least two degrees of freedom of movement, including a first degree of freedom to move horizontally and a second degree of freedom to move vertically;

wherein, during operation:

(d) (i) said lift fork is configured to move horizontally to a retracted position;

(ii) said lift fork is configured to move vertically to an upper position that corresponds to a vertical elevation of said second staple strip;

(iii) said lift fork is configured to move horizontally to an extended position that is at least partially within an open area of said second staple strip, but is not yet making physical contact with said second staple strip;

(iv) while remaining in said horizontally extended position, said lift fork is configured to move vertically upward until it makes physical contact with at least one leg of said second staple strip, then to continue to move slightly upward while lifting said plurality of staple strips, except for the first staple strip, which is not lifted upward, until a gap is created between a bottom-most surface of said second staple strip and a top-most surface of said first staple strip;

(e) (i) said pusher is configured to move horizontally from its retracted position toward its extended position, until it makes physical contact with said first staple strip;

(ii) said pusher is configured to continue moving toward said extended position, while pushing said first staple strip toward an exit position, until said first staple strip has cleared from beneath said second staple strip;

(iii) said pusher is configured to move horizontally from its extended position toward its retracted position, until it clears from beneath said second staple strip, while releasing from contact from said first staple strip;

(f) (i) said lift fork is configured to move vertically downward to a lower position until said second staple strip rests up on a surface, said downward movement being controlled so as to be sufficiently gentle so as to not break any of the individual staples that comprise said second staple strip;

(ii) said lift fork is configured to move horizontally from its extended position to its retracted position, while not making physical contact with said second staple strip;

(iii) said lift fork is configured to move vertically upward from said lower position to said upper position; and (g) said second staple strip has now become disposed at the bottom-most position in said magazine, and said first staple strip has been moved to said exit position.

2. The lifting machine of claim 1, further comprising: a base support as part of said pusher subassembly, said base support holding said first staple strip at a proper elevation while it is disposed at a bottom-most position in said magazine.

3. The lifting machine of claim 1, further comprising:

(a) a second linear cylinder, including a second movable rod;

(b) an energy chain that is in mechanical communication with said second movable rod; at a first end of the energy chain; and (c) a lift fork connector that is in mechanical communication with said energy chain at a second end of the energy chain.

4. The lifting machine of claim 1, further comprising, in said lifter subassembly:

(a) a first actuator for controlling vertical movements of said lift fork; and (b) a second actuator for controlling horizontal movements of said lift fork.

5. The lifting machine of claim 1, wherein:

(a) an orientation of said plurality of staple strips, while stacked in said magazine, is as follows:

(i) a transverse leg is vertical and two penetrating legs are horizontal, such that when said lift fork moves vertically upward until it makes physical contact with at least one leg of said second staple strip, the lift fork contacts one of the horizontal penetrating legs; or (ii) a transverse leg is horizontal and two penetrating legs are vertical, such that when said lift fork moves vertically upward until it makes physical contact with at least one leg of said second staple strip, the lift fork contacts the transverse leg.

6. The lifting machine of claim 1, further comprising, in the magazine: at least one vertical support guide to hold said plurality of stacked staple strips in a correct position.

7. The lifting machine of claim 1, further comprising: proximal to said exit position, at least one horizontal support guide to direct said first staple strip as it exits the lifting machine, and is directed to an automated stapler.

8. A method for using a lifting machine that feeds staples, said method comprising the steps of:

(a) providing a magazine, including a space to hold a plurality of staple strips that are stacked, one staple strip atop a next staple strip, wherein there is a first staple strip disposed at a bottom-most position in said magazine, and a second staple strip disposed at a position just above said first staple strip;

(b) providing a pusher subassembly that comprises:

(i) a first linear cylinder; including a first movable rod;

(ii) a pusher that has at least one degree of freedom of movement in a horizontal direction and that is sized and shaped to contact an end portion of said first staple strip; and (iii) a cylinder connector that is in mechanical communication with said pusher and which moves in accordance to a position of said first movable rod of the first linear cylinder;

(c) providing a lifter subassembly that comprises:

(i) a lift fork that has at least two degrees of freedom of movement, including a first degree of freedom to move horizontally and a second degree of freedom to move vertically;

wherein, during operation:

(d) (i) moving said lift fork horizontally to a retracted position;

(ii) moving said lift fork vertically to an upper position that corresponds to a vertical elevation of said second staple strip;

(iii) moving said lift fork horizontally to an extended position that is at least partially within an open area of said second staple strip, but is not yet making physical contact with said second staple strip;

(iv) while remaining in said horizontally extended position, moving said lift fork vertically upward until it makes physical contact with at least one leg of said second staple strip, then continuing to move slightly upward while lifting said plurality of staple strips, except for the first staple strip, which is not lifted upward, until a gap is created between a bottom-most surface of said second staple strip and a top-most surface of said first staple strip;

(e) (i) moving said pusher horizontally from its retracted position toward its extended position, until it makes physical contact with said first staple strip;

(ii) moving said pusher further toward said extended position, while pushing said first staple strip toward an exit position, until said first staple strip has cleared from beneath said second staple strip;

(iii) moving said pusher horizontally from its extended position toward its retracted position, until it clears from beneath said second staple strip, while releasing from contact from said first staple strip;

(f) (i) moving said lift fork vertically downward to a lower position until said second staple strip rests up on a surface, said downward movement being controlled so as to be sufficiently gentle so as to not break any of the individual staples that comprise said second staple strip;

(ii) moving said lift fork horizontally from its extended position to its retracted position, while not making physical contact with said second staple strip;

(iii) moving said lift fork vertically upward from said lower position to said upper position; and (g) said second staple strip has now become disposed at the bottom-most position in said magazine, and said first staple strip has been moved to said exit position.

9. The method of claim 8, further comprising: providing a base support as part of said pusher subassembly, said base support holding said first staple strip at a proper elevation while it is disposed at a bottom-most position in said magazine.

10. The method of claim 8, further comprising:

(a) providing a second linear cylinder, including a second movable rod;

(b) providing an energy chain that is in mechanical communication with said second movable rod; at a first end of the energy chain; and (c) providing a lift fork connector that is in mechanical communication with said energy chain at a second end of the energy chain.

11. The method of claim 8, further comprising, in said lifter subassembly:

(a) providing a first actuator for controlling vertical movements of said lift fork; and (b) providing a second actuator for controlling horizontal movements of said lift fork.

12. The method of claim 8, wherein:

(a) an orientation of said plurality of staple strips, while stacked in said magazine, is as follows:

(i) a transverse leg is vertical and two penetrating legs are horizontal, such that when said lift fork moves vertically upward until it makes physical contact with at least one leg of said second staple strip, the lift fork contacts one of the horizontal penetrating legs; or (ii) a transverse leg is horizontal and two penetrating legs are vertical, such that when said lift fork moves vertically upward until it makes physical contact with at least one leg of said second staple strip, the lift fork contacts the transverse leg.

13. The method of claim 8, further comprising, in the magazine: providing at least one vertical support guide to hold said plurality of stacked staple strips in a correct position.

14. The method of claim 8, further comprising: proximal to said exit position, providing at least one horizontal support guide to direct said first staple strip as it exits the lifting machine, and is directed to an automated stapler.

* * * * *